United States Patent [19]

Brust et al.

[11] 4,088,499

[45] May 9, 1978

[54] SELECTIVELY PERMEABLE LAYERS FOR DIFFUSION TRANSFER FILM UNITS

[75] Inventors: David Philip Brust; Tsang Jan Chen; Ignazio Salvatore Ponticello; Zona Reynolds Pierce, all of Rochester, N.Y.

[73] Assignee: Eastman Kodak Company, Rochester, N.Y.

[21] Appl. No.: 701,935

[22] Filed: Jul. 1, 1976

[51] Int. Cl.[2] ..... G03C 7/00; G03C 5/54; G03C 1/40; G03C 1/48

[52] U.S. Cl. ..... 96/29 D; 96/3; 96/76 R; 96/76 C; 96/77

[58] Field of Search ..... 96/3, 29 D, 77, 76 R, 96/76 C

[56] References Cited

U.S. PATENT DOCUMENTS

| | | | |
|---|---|---|---|
| 3,459,790 | 8/1969 | Smith | 260/483 |
| 3,488,708 | 1/1970 | Smith | 96/84 R |
| 3,554,987 | 1/1971 | Smith | 260/79.3 |
| 3,658,878 | 4/1972 | Smith | 260/465.4 |
| 3,679,409 | 7/1972 | Buckler et al. | 96/29 D |
| 3,904,418 | 9/1975 | Mowrey et al. | 96/76 R |

*Primary Examiner*—J. Travis Brown
*Assistant Examiner*—Richard C. Schilling
*Attorney, Agent, or Firm*—Arthur H. Rosenstein

[57] ABSTRACT

Disclosed herein is an image-transfer film unit comprising:

(1) a photosensitive element comprising a support, having thereon at least one silver halide emulsion layer;

(2) an image-receiving layer:

(3) interposed between any silver halide emulsion layer and said image-receiving layer, at least one pH selectively permeable layer comprising:

(a) from about 1 to 100 mole percent of a polymerized monomer containing at least one active methylene group and having the formula:

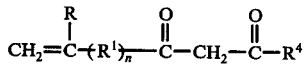

wherein n is 0 or 1; R is hydrogen or methyl; $R^1$ is substituted or unsubstituted arylenethylene having the structure:

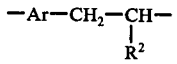

wherein Ar is arylene and $R^2$ is hydrogen, alkyl, aryl or cycloalkyl, or $R^1$ has the formula:

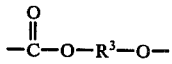

wherein $R^3$ is alkylene, arylene or cycloalkylene; and $R^4$ is alkyl, alkoxy or amino when *n* is equal to 0, and $R^4$ is alkyl, alkoxy, amino, cycloalkyl or aryl when *n* is equal to 1;

(b) from 0 to about 90 mole percent of at least one additional hydrophilic polymerized ethylenically unsaturated monomer; and (c) from 0 to about 80 mole percent of at least one additional hydrophobic polymerized ethylenically unsaturated monomer; and (4) means containing an alkaline processing composition adapted to discharge its contents within said film unit.

32 Claims, No Drawings

SELECTIVELY PERMEABLE LAYERS FOR DIFFUSION TRANSFER FILM UNITS

This invention relates to the use of polymeric materials in photographic elements and processes to obtain a desirable combination of properties. In particular, this invention relates to methods and materials for controlling dye migration in diffusion transfer color processes. A preferred embodiment of this invention is the use of certain active methylene group-containing polymers as pH selectively permeable layers to control dye diffusion in diffusion transfer film units and processes.

BACKGROUND OF THE INVENTION

Diffusion transfer processes are photographic processes which can, for example, utilize the nondeveloped silver halide in the nonimage areas of the negative to form a positive by dissolving the underdeveloped silver halide and precipitating it on a receiving layer in close proximity to the original silver halide emulsion layer. Other well-known diffusion transfer processes include the migration of dyes, color formers, developing agents, etc., imagewise from the photosensitive layer or layers to an imagereceiving layer. Such processes and film units using such are described in U.S. Pat. Nos. 2,352,014, 2,543,181, 2,983,606, 3,020,155, 3,227,550, 3,227,552, 3,415,645, 3,415,644, 3,415,646 and 3,635,707; Canadian Pat. Nos. 674,082; 928,559 and 928,560; and British Pat. Nos. 904,364 and 840,731.

The use of spacer layers or timing layers to delay the function of neutralizing layers in diffusion transfer processes is described in various patents, for example, U.S. Pat. Nos. 2,584,030 issued Jan. 29, 1952, 3,362 819 issued Jan. 9, 1968, 3,419,389 issued Dec. 31, 1968, 3,421,893 issued Jan. 14, 1969, 3,433,633 issued Mar. 18, 1969, 3,455,686 issued July 15, 1969, 3,592,645 issued July 13, 1971, 3,756,815 issued Sept. 4, 1973, and 3,765,893 issued Oct. 16, 1973 and in Research Disclosure, vol. 123, July, 1974, Item 12331, entitled "Neutralizing Materials in Photographic Elements".

Spacer layers are also generally used in multicolor photographic products to separate the respective image dye-forming layer units from each other, as shown in Neblette, Photography, Its Materials and Processes, Sixth Edition, 1962, page 448. Specific polymeric materials which have been demonstrated to be effective as barrier layers between dye image-forming units are disclosed in U.S. Pat. No. 3,384,483 issued May 21, 1968. Additional polymers suggested for use as barrier layers are disclosed in U.S. Pat. Nos. 3,345,163 issued Oct. 3, 1967 and 3,625,685.

Processing solutions for image-transfer film units which contain polymers which are soluble in strongly alkaline solutions (greater than pH 11.0), but are insoluble and precipitate out when the pH is reduced to 7 to 10, are disclosed by Haas et al, U.S. Pat. No. 3,362,822. Typical materials disclosed are polyphenolic polymers such as the acetal of hydroxybenzaldehyde and polyvinyl alcohol, sulfonamides such as the acetal of a paraformylbenzenesulfonamide and polyvinyl alcohol, polymers comprising α-trifluoromethylvinyl alcohol segments, the benzenesulfonamide of deacetylated chitin, polyhydroxymethylene, the acetal of 3-hydroxybenzaldehyde and a vinyl alcohol-α-trifluoromethylvinyl alcohol copolymer, novolak phenol formaldehyde polymers, etc.

The use of barrier layers during development in image diffusion transfer elements, particularly integral elements, to prevent diffusion of materials to the image-receiving layer is described, for example, in U.S. Pat. No. 3,679,409 by Buckler et al. The purpose of the barrier layer is to allow diffusion of image-forming materials or products thereof at high pH, such as the pH of the processing composition, and to prevent diffusion of such materials at low pH. In this way, diffusion of the image-forming materials is prevented after processing.

Various polymers are disclosed in Buckler et al as being useful as barrier layers between the photosensitive layers and the image-receiving layers in image-transfer film units. Still other means for forming barrier layers are disclosed in U.S. Pat. Nos. 3,576,626 issued Apr. 27, 1971, and 3,597,197 issued Aug. 3, 1971.

Although several of the polymers disclosed in the prior art do function as barrier layers and some of the polymers have high permeability with high-pH conditions and relatively low permeability under low-pH conditions, it was found that the materials used for barrier layers had other undesirable properties. In particular, problems are encountered in polymeric materials suggested by Haas et al and Buckler et al when they are coated as layers in a photographic element. Generally, the polymeric materials may not harden well and, in some instances such as with the polyols and polyol derivatives, the adhesion between layers (particularly gelatin-containing layers) can be poor, causing blistering and delamination. Such blistering is known to cause white spots in images obtained by diffusion transfer since dye transfer is prevented by the discontinuities in the coatings.

It is evident that there is a need for improved materials which can be used as "barrier" layers, allowing diffusion of image-forming materials or products thereof at high pH but preventing diffusion of such materials at low pH.

The use of polymers generally in photographic elements as vehicle replacements and for other special purposes is well-known in the art. In U.S. Pat. No. 3,488,708 by Smith issued Jan. 6, 1970, polymers are disclosed for use in photographic elements and image-transfer film units, which polymers contain active methylene groups which serve as crosslinking sites. Related polymers of this type are also disclosed in U.S. Pat. Nos. 3,459,770, 3,554,987 and 3,658,878.

Japanese Pat. No. 7,002,726 describes photosensitive materials comprising copolymers of the general formula:

$$CH_2{=}\overset{\overset{\displaystyle R}{|}}{C}{-}COCH_2R^1$$

wherein R and $R^1$ are hydrogen or a lower alkyl, halide, OH, or acetyl or acetoxy groups and at least one vinyl monomer selected from styrene, acrylonitrile, vinyl acetate, vinyl chloride, ethyl methacrylate and acrylamide.

U.S. Ser. No. 497,803 filed Aug. 15, 1974 by I. S. Ponticello, now U.S. Pat. No. 3,939,130, discloses crosslinkable polymers containing active methylene crosslinking sites in at least some of the side chains, wherein the group joining the side chain to the polymer backbone possesses increased resistance to hydrolysis. The use of certain of these polymers in photographic elements is disclosed in U.S. Ser. No. 577,141 filed Aug. 13, 1975, now U.S. Pat. No. 3,929,482.

In U.S. Pat. No. 3,904,418 issued Sept. 9, 1975 entitled "Hardenable Vehicles for Silver Halide Emulsions," I. S. Ponticello and R. Mowrey disclose the use of active methylene group-containing polymers to provide improved photographic elements adapted for silver-dye bleach processes.

SUMMARY OF THE INVENTION

We have now discovered that certain types of polymers can be used as barrier layers in photographic elements and particularly in image-transfer film units which are processed with highly alkaline compositions, with improved results compared with polymers used in the prior art for this purpose. Generally, the polymers used in the barrier layers of the invention are copolymers comprising recurring units of a polymerized monomer containing at least one active methylene group having the formula:

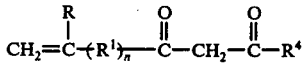

wherein $n$ is 0 or 1; R is hydrogen or methyl; $R^1$ is substituted or unsubstituted arylenethylene having the structure:

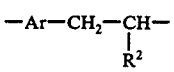

wherein Ar is arylene and $R^2$ is hydrogen, alkyl, aryl or cycloalkyl, or $R^1$ has the formula:

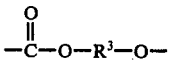

wherein $R^3$ is alkylene, arylene or cycloalkylene; and $R^4$ is alkyl, alkoxy or amino when $n$ is equal to 0, and $R^4$ is alkyl, alkoxy, amino, cycloalkyl or aryl when $n$ is equal to 1.

The use of these polymers as barrier layers provides for barrier layers which can be crosslinked to gelatin prior to use to provide good interlayer adhesion, does not require posthardening to substantially terminate diffusion, and resists blistering or delamination.

In one aspect, this invention comprises an image-transfer film unit comprising:

(a) a support having thereon at least one silver halide emulsion layer;
(b) an image-receiving layer;
(c) interposed between any silver halide emulsion layer and said image-receiving layer, at least one pH selectively permeable layer comprising a homopolymer or a copolymer comprising recurring units of a polymerized monomer containing at least one active methylene group and having the formula:

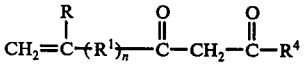

wherein $n$ is 0 or 1; R is hydrogen or methyl; $R^1$ is substituted or unsubstituted arylenethylene having the structure:

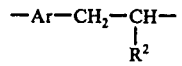

wherein Ar is arylene and $R^2$ is hydrogen, alkyl, aryl or cycloalkyl, or $R^1$ has the formula:

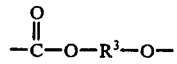

wherein $R^3$ is alkylene, arylene or cycloalkylene; and $R^4$ is alkyl, alkoxy or amino when $n$ is equal to 0, and $R^4$ is alkyl, alkoxy, amino, cycloalkyl or aryl when $n$ is equal to 1; and (d) means containing an alkaline processing composition adapted to discharge its contents within said film unit.

DESCRIPTION OF THE PREFERRED EMBODIMENTS

In one aspect, a preferred embodiment of the present invention comprises an image-transfer film unit comprising:

(1) a photosensitive element comprising a support, having thereon at least one silver halide emulsion layer;
(2) an image-receiving layer;
(3) interposed between any silver halide emulsion layer and said image-receiving layer at least one selectively permeable layer comprising a polymer comprising recurring units of:
  (a) from about 1 to 100 mole percent of a polymerized monomer containing at least one active methylene group and having the formula:

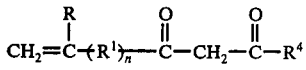

wherein $n$ is 0 or 1; R is hydrogen or methyl; $R^1$ is substituted or unsubstituted arylenethylene having the structure:

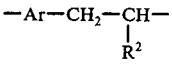

wherein Ar is arylene and $R^2$ is hydrogen, alkyl, aryl or cycloalkyl, or $R^1$ has the formula:

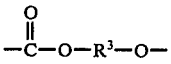

wherein $R^3$ is alkylene, arylene or cycloalkylene; and $R^4$ is alkyl, alkoxy or amino when $n$ is equal to 0, and $R^4$ is alkyl, alkoxy, amino, cycloalkyl or aryl when $n$ is equal to 1;

(b) from 0 to about 90 mole percent of at least one additional hydrophilic polymerized ethylenically unsaturated monomer; and
  (c) from 0 to about 80 mole percent of at least one additional hydrophobic polymerized ethylenically unsaturated monomer; and (4) means containing an alkaline processing composition adapted to discharge its contents within said film unit.

In another aspect, a preferred embodiment of this invention comprises a photosensitive, color diffusion transfer element comprising a support, having thereon:

(1) at least one silver halide emulsion layer;

(2) an image-receiving layer;

(3) interposed between any silver halide emulsion layer and said image-receiving layer at least one selectively permeable layer comprising a homopolymer or a copolymer comprising:

(a) from about 1 to 100 mole percent of a polymerized monomer containing at least one active methylene group and having the formula:

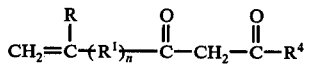

wherein $n$ is 0 or 1; R is hydrogen or methyl; $R^1$ is substituted or unsubstituted arylenethylene having the structure:

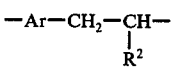

wherein Ar is arylene and $R^2$ is hydrogen, alkyl, aryl or cycloalkyl, or $R^1$ has the formula:

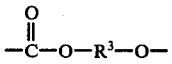

wherein $R^3$ is alkylene, arylene or cycloalkylene; and $R^4$ is alkyl, alkoxy or amino when $n$ is equal to 0, and $R^4$ is alkyl, alkoxy, amino, cycloalkyl or aryl when $n$ is equal to 1;

(b) from 0 to about 90 mole percent of at least one additional hydrophilic polymerized ethylenically unsaturated monomer; and (c) from 0 to about 80 mole percent of at least one additional hydrophilic polymerized ethylenically unsaturated monomer; and (4) means containing an alkaline processing composition adapted to discharge its contents within said film unit.

It has been found that diffusion transfer film units and elements can be made by incorporating therein at least one pH selectively permeable layer comprising a homopolymer or a copolymer having active methylene groups appended thereto. These pH selectively permeable layers are interposed between an image-receiving layer and the silver halide emulsion layers. The term "pH selectively permeable" is used to describe a layer which allows only certain materials to pass through it, such as image-forming materials or products thereof, and which does so only at particular pH values, such as a pH in excess of 11 or at a pH of a different value depending on the polymer used.

When contacted with an adjacent gelatin-containing or similar hardenable hydrophilic colloid-containing layer, this "barrier" or pH selectively permeable layer can be chemically crosslinked thereto with or without conventional gelatin crosslinking agents. As the gelatin layers often contain residual hardener which effects a sufficient degree of crosslinking, it is not generally necessary to add hardeners to this layer. Alternatively, additional hardener can be added to the selectively permeable layer in an amount from about 0 to 3.0 percent by weight of the polymer, and preferably from about 0.75 to 1.5 percent of the polymer by weight. When subjected to a pH change such as from high to low, the polymeric materials described herein do not blister or delaminate compared with barrier layers of the prior art. At high pH, i.e., in excess of 11, dye and other image-forming materials readily diffuse through the polymeric layer, and at low pH, i.e., below 7, diffusion is substantially terminated.

The diffusability through the pH selectively permeable layers can be somewhat related to three chemical properties: the pKa of the active methylene group-containing monomers employed to make the polymers, the degree of hydrophilicity or hydrophobicity of the polymers, and the degree of crosslinking of the polymers. If the pKa of the monomers is high (11 to 12), the barrier will exhibit good diffusion shutdown, but may require lengthy dye diffusion times (times required for dyes to diffuse through a barrier layer at high pH and form adequate deposits of dyes in the receiving layer). Conversely, if the pKa is low (4 to 5), short diffusion times may be allowed, but shutdown would not be as complete. Forthe cyan dye of Test I below, a satisfactory dye diffusion time is 1 minute or less.

Dye diffusion can be improved by copolymerizing the active methylene group-containing monomers with hydrophilic monomers such as acrylamide, methacrylamide, and N-substituted derivatives thereof; acrylic and methacrylic acids; sulfoalkyl acrylates and methacrylates such as N-isopropyl acrylamide, N-(1,1-dimethyl-3-dimethylaminopropyl)acrylamide, N-(1,1-dimethyl-3-diethylaminopropyl)acrylamide, acrylic acid, methacrylic acid (m- and p-vinylphenyl) acetic acid, o-, m- and p-vinylbenzolic acid, 3-acrylamido-3-methylbutanoic acid, sodium 3-methacryloyloxypropane-1-sulfonate, sodium 3-acryloyloxypropane-1 sulfonate, sodium 4-acryloyloxybutane-2-sulfonate, sodium 2-acrylamido-2-methylpropane-sulfonate and the like and salts thereof; hydroxyalkyl acrylates and methacrylates such as hydroxymethyl acrylate, hydroxyethyl methacrylate and the like; amino- and substituted aminoalkyl acrylates, methacrylates, or acrylic amides, such as 2-hydroxyethyl acrylate, 2-hydroxypropyl acrylate, 2-hydroxypropyl methacrylate, 2-(N,N-diethylamino)ethyl acrylate, 2-(N,N-diethylamino)ethyl methacrylate and the like; vinylsulfonanilides such as p-methanesulfonamido)styrene, and p-benzenesulfonamido)-styrene and the like. The dye diffusion shutdown property of the barrier layer can be improved by copolymerizing the active methylene group containing monomers with hydrophobic monomers such as alkyl acrylates and methacrylates such as methyl acrylate, ethyl acrylate, butyl acrylate, methyl methacrylate, ethyl methacrylate, butyl methacrylate and the like, and styrene and substituted styrenes such as styrene p-tert-butylstyrene, α-methylstyrene, p-bromostyrene and the like.

Diffusion and shutdown can also be altered by the degree of crosslinking of the active methylene group-containing polymers. Thus, wide latitude in the diffusion and shutdown properties of the pH selectively permeable layers can be obtained by proper adjustment of these properties. As a slight degree of crosslinking between the active methylene groups often occurs without the presence of a conventional photographic hardening agent in certain embodiments, addition of a hardener is not necessary, particularly in view of the fact that residual hardening agent in adjacent gelatin layers can be sufficient to promote suitable adhesion.

The homopolymers and copolymers used in the practice of this invention are addition homopolymers and copolymers containing active methylene groups in the side chains of the polymers. Active methylene groups, as described herein, are methylene groups between two electronegative groups such as carbonyl and cyano. Such methylene groups exhibit unusual chemical activity and are said to be "active."

The molecular weights of the polymers of this invention are subject to wide variation, but are often in the range of about 5,000 to about 500,000. These polymers, which are generally water-insoluble, preferably have inherent viscosities (0.25 g. polymer in 100 ml. of solution at 25° C.) from 0.10 to 2.0, more preferably from about 0.25 to about 1.25 when measured in 2-butanone or acetone. As used herein, the term "inherent viscosity" is determined by the formula:

$$\eta = (2.30 \log \eta)/C$$

wherein $\eta$ is the inherent viscosity, $\eta$ is the relative viscosity of solution of the polymer in the solvent in which the viscosity is to be measured such as water or solvent such as acetone or 2-butanone divided by the viscosity of the water in the same units and at the same temperature, and C is the concentration in grams (0.25) of polymer per 100 cc. of solution.

Although certain active methylene group-containing homopolymers can be used as pH gates (or barriers) according to this invention, preferred embodiments comprise copolymers of active methylene group-containing monomers and hydrophilic and/or hydrophobic comonomers. Since the corsslinking capability of the hardenable monomers is so effective, small amounts of the active methylene group-containing monomers are sufficient when large amounts of hydrophilic monomers, especially acrylic acids, are employed, yet the hardenable monomers are sufficiently hydrophilic that little or no additional hydrophilic monomer need be used if a large amount of active methylene group-containing monomer is used. Nevertheless, a preferred class of barrier-layer polymers according to this invention is that derived from 1 to 100 mole percent of an active methylene group-containing monomer, 0 to 9 mole percent of another hydrophilic monomer and 0 to 80 mole percent of a hydrophobic monomer. It is to be understood that the term "monomer" in the singular is intended to include a mixture of monomers of the class specified.

As noted above, the image-transfer film units and photosensitive diffusion transfer elements comprise at least one silver halide emulsion layer, an image-receiving layer and, either in the image-receiving layer or interposed between any silver halide emulsion and said image-receiving layer, at least one selectively permeable layer comprising homopolymers or copolymers of a first polymerized monomer with up to 99 mole percent of a combination of at least one hydrophilic monomer and at least one hydrophobic monomer, said first polymerized monomer having the formula:

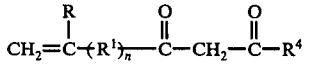

wherein:

$n$ is 0 or 1.

R is hydrogen or methyl.

$R^1$ can be substituted or unsubstituted arylenethylene, having the structure:

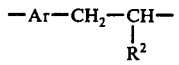

wherein Ar is arylene, preferably of from 6 to 12 carbon atoms, e.g., phenyl, naphthyl, which can be substituted, if desired, with alkyl or alkoxy groups, preferably of from 1 to 10 carbon atoms, as exemplified by methyl, ethyl, propyl, butyl, pentyl, hexyl, heptyl, octyl, nonyl, decyl, and isomers thereof, methoxy, ethoxy, propoxy, butoxy, pentyloxy, etc.; more preferably, where Ar is substituted, it is substituted with lower alkyl or alkoxy groups of from 1 to 5 carbon atoms or cycloalkyl, preferably of from 5 to 7 carbon atoms, such as, for example, cyclopentyl, cyclohexyl or cycloheptyl, cyano, halide such as bromide, chloride, fluoride and iodide, and others known to those skilled in the art. $R^2$ is hydrogen, alkyl, aryl or cycloalkyl, as described above. $R^1$ can also be a group having the formula:

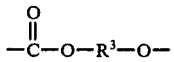

wherein $R^3$ is alkylene, arylene or cycloalkylene such as ethylene, 1-methylethylene, phenylene, cyclohexylene and the like.

When $n$ is equal to 0, $R^4$ can be alkyl or alkoxy, preferably of from 1 to 10 carbon atoms, more preferably of from 1 to 5 carbon atoms as described above, and amino, such as those having the structure:

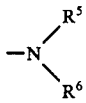

wherein $R^5$ and $R^6$ are hydrogen, substituted or unsubstituted alkyl, preferably containing from 1 to 10 carbon atoms, substituted or unsubstituted cycloalkyl, preferably of from 5 to 7 carbon atoms, such as, for example, cyclopentyl, cyclohexyl or cycloheptyl, or substituted or unsubstituted aryl, preferably of from 6 to 12 carbon atoms as described above, e.g., phenyl and naphthyl.

When $n$ is equal to 1, $R^4$ can be any of the groups described above in addition to cycloalkyl such as cyclohexyl, cyclopentyl and the like or aryl, preferably containing from 6 to 12 carbon atoms such as phenyl, naphthyl, tolyl, benzyl and the like.

Some of the particularly useful monomers containing active methylene groups are ethyl acryloylacetate, tert-butyl acryloylacetate, 2-acetoacetoxyethyl methacrylate, ethyl 5-(m- and p-vinylphenyl)-3-oxopentanoate, t-butyl 5-(m- and p-vinylphenyl)-3-oxopentanoate, N,N-diethyl-5-(m- and p-vinylphenyl)-3-oxopentanoic acid amide, acryloylacetone, methacryloylacetone, 6-(m- and p-vinylphenyl)-2,4-hexanedione, and N,N-dimethylacryloylacetamide.

These monomers can be polymerized to advantage with themselves or with one or more monomers as shown in the following preferred embodiments of this invention: a copolymer of ethyl acryloylacetate (40–50 mole percent) and N-isopropylacrylamide (60–50 mole percent); a copolymer of 2-acetoacetoxyethyl methacrylate (65 mole percent) and acrylamide (35 mole percent); a homopolymer of 2-acetoacetoxyethyl methacrylate; a terpolymer of 2-acetoacetoxyethyl methacrylate (1–3 mole percent), acrylic acid (25–32 mole percent) and ethyl acrylate (74–65 mole percent); a copolymer of ethyl 5-(m- and p-vinylphenyl)-3-oxopentanoate (10–15 mole percent) and N-isopropylacrylamide (90–85 mole percent); and a copolymer of 6-(m- and p-vinylphenyl)-2,4-hexanedione (20–35 mole percent) and N-isopropylacrylamide (80–65 mole percent).

As noted above, polymers used in the practice of this invention may comprise up to 90 mole percent of at least one additional hydrophilic polymerized ethylenically unsaturated monomer.

Polymers used in the practice of this invention may also comprise up to 80 mole percent of at least one additional hydrophobic polymerized ethylenically unsaturated monomer. As exemplary of such monomers may be listed: alkyl acrylates and methacrylates such as methyl acrylate, methyl methacrylate, ethyl acrylate, ethyl methacrylate, n-butyl acrylate, n-butyl methacrylate, etc.; styrene and substituted styrenes such as $\alpha$-methylstyrene, p-bromostyrene, p-t-butylstyrene, vinyltoluene, etc.; and others known to those skilled in the art.

When the polymer contains up to 30% by weight of one or more of the monomers containing active methylene groups, the polymerization can usually be carried out as a solution polymerization in a suitable medium, for example, water or mixtures of water with water-miscible solvents, as exemplified by methanol, ethanol, propanol, isopropanol, and the like. When the polymer contains more than 30% by weight of one or more monomers containing active methylene groups, the polymerization can usually be carried out by solution polymerization in a suitable organic solvent, for example, acetone, benzene, cyclohexanone, N,N-dimethylformamide, dimethyl sulfoxide, tetrahydrofuran, and the like, or by aqueous emulsion or suspension polymerization according to methods well-known to those skilled in the art.

The temperature at which the polymers described herein are prepared is subject to wide variation, since this temperature depends upon such variable features as the specific monomer used, duration of heating, pressure employed and like considerations. However, the polymerization temperature generally does not exceed about 110° C., and most often it is in the range of about 50 to about 100° C.

The pressure employed in the polymerization is usually sufficient only to maintain the reaction mixture in liquid form, although either superatmospheric or subatmospheric pressures can be used where such use is advantageous. The concentration of polymerizable monomer in the polymerization mixture can be varied widely with concentrations up to about 100%, by weight, and preferably about 20 to about 70%, by weight, based on the weight of the polymerization, being satisfactory. Suitable catalysts for the polymerization reaction include, for example, the free radical catalysts such as hydrogen peroxide, cumene hydroperoxide, water-soluble azo-type initiators and the like. In redox polymerization systems, conventional ingredients can be employed. If desired, the polymer can be isolated from the reaction vehicle by freezing, salting out, precipitation or any other procedure suitable for this purpose.

As indicated in U.S. Pat. No. 3,142,568 issued July 28, 1964, it is sometimes advantageous to include a surface active agent or compatible mixtures of such agents in the preparation of vinyl or addition polymers. Suitable wetting agents include the nonionic, ionic and amphoteric types as exemplified by the polyoxyalkylene derivatives, amphoteric amino acid dispersing agents, including sulfobetaines, and the like. Such wetting agents are disclosed in U.S. Pat. Nos. 2,600,831, 2,271,623, 2,275,727, 2,787,604, 2,816,920 and 2,739,891.

The barrier layer can be formed, for example, by merely coating the polymer from a suitable organic solvent or in the case of polymers containing sufficent carboxylic acid, the film can be coated from water at about pH 7.0.

The polymeric materials disclosed herein are advantageously used in image-transfer film units and in photosensitive diffusion transfer elements wherein it is desired to process with a highly alkaline processing composition and in those instances where the film unit remains laminated together after processing. The alkaline-resistant polymers disclosed herein are generally useful in image-transfer film units which comprise:

(1) a photosensitive element comprising a support having thereon at least one layer containing a silver halide emulsion preferably having associated therewith an image dye-providing material and more preferably at least three of said layers which contain, respectively, a blue-sensitive silver halide emulsion, a green-sensitive silver halide emulsion and a red-sensitive silver halide emulsion;

(2) an image-receiving layer which can be located on a separate support and superposed on said support containing said silver halide emulsion layers or, preferably, it can be coated on the same support adjacent to the photosensitive silver halide emulsion layers; and (3) means containing an alkaline processing composition adapted to discharge its contents within said film unit.

Where the receiver layer is coated on the same support with the photosensitive silver halide layers, the support is preferably a transparent support, an opaque layer is preferably positioned between the image-receiving layer and the photosensitive silver halide layer, and the alkaline processing composition preferably contains an opacifying substance such as carbon or a pH-indicator dye and a pigment such as $TiO_2$ which is discharged into the film unit between a dimensionally stable support or cover sheet and the photosensitive element.

A means for containing the alkaline processing solution can be any means known in the art for this purpose, including rupturable containers positioned at the point of desired discharge of its contents into the film unit and adapted to be passed between a pair of juxtaposed rollers to effect discharge of the contents into the film unit, frangible containers positioned over or within the photosensitive element, hypodermic syringes, and the like. This means can also be a method of contacting the film unit or photosensitive element with an alkaline processing solution on another support or in a processing bath, outside of the film unit or element.

The terms "image dye-providing material" or "image-forming materials" are understood to refer to those compounds which either 1) do not require a chemical reaction to form the image dye or 2) undergo reactions encountered in photographic imaging systems to produce an image dye, such as with color couplers, oxichromic compounds, hydrolyzable dye derivatives and the like. The first class of compounds is generally referred to a preformed image dyes and includes pHshifted dyes, etc., while the second class of compounds is generally referred to as "shiftable dyes" or dye precursors.

The terms "initially diffusible" and "initially immobile" as used hereinafter refer to compounds which are incorporated in the photographic element and, upon contact with an alkaline processing solution, are substantially diffusible or substantially immobile, respectively.

The image dye-providing materials, in one preferred embodiment where negative silver halide emulsions are used, can be initially mobile image dye-providing materials such as those used in image-transfer photographic elements. Typically useful, initially mobile image dye-providing materials include dye developers as disclosed in U.S. Pat. Nos. 2,983,606, 3,255,001 and the like; oxichromic developers which undergo chromogenic oxidation to form image dyes as disclosed in U.S. Pat.No. 3,880,658 issued Apr. 29, 1975; shifted indophenol dye developers as disclosed in Bush and Reardon, U.S. Pat. No. 3,854,945 issued Dec. 17, 1974; metalized dye developers as disclosed in U.S. Pat. Nos. 3,482,972, 3,544,545, 3,551,406 and 3,563,739; and the like; all of which are incorporated herein by reference.

In another embodiment, immobile image dye-providing compounds can be used in association with silver halide emulsions wherein said compounds undergo oxidation followed by hydrolysis to provide an imagewise distribution of a mobile image dye. Compounds of this type can be used with negative emulsions to form positive image records in the exposed photographic element, or they can be used with direct-positive or reversal emulsions to form positive transfer images such as in an image-transfer film unit. Typical useful compounds of this type are disclosed in Canadian Pat. No. 602,607 by Whitmore et al issued Aug. 2, 1960, Belgian Pat. Nos. 788,268 by Fleckenstein et al of Feb. 28, 1973, and 140,211 by Hinshaw et al of Jan. 25, 1974, and U.S. Pat. Nos. 3,698,897 by Gompf et al, 3,728,113 by Becker et al, 3,725,062 by Anderson et al, 3,227,552 by Whitmore, 3,443,939, 3,443,940 and 3,443,941, all of which are incorporated herein by reference. The polymers described herein can also be used in azo dye transfer processes wherein, for example, a negative emulsion yields a positive image such as described in U.S. Pat. No. 2,728,290.

The light-sensitive elements described herein can be coated on a wide variety of supports, including film bases such as poly(ethylene terephthalate), cellulose acetate butyrate, polycarbonate, polyolefins (e.g., polyethylene and polypropylene) and the like. When transparent film bases for the transferred image layer are used, the photographic product obtained can be used, for example, as a transparency. If desired, the emulsions can be coated on an opaque support or reflecting film support such as paper, polyolefin-coated paper such as polyethylene- or polypropylene-coated paper which can be pigmented, with $TiO_2$, for example, and electron-bombarded to promote emulsion adhesion. When such supports are used, a color photographic print may be obtained.

The emulsions used in the photographic elements of this invention can be chemically sensitized with compounds of the sulfur group as described by Sheppard et al, U.S. Pat. No. 1,623,499 issued Apr. 5, 1927, and noble metal salts such as gold salts, and reduction-sensitized with reducing agents, and combinations of these. These polymers are especially useful to obtain hardened emulsions containing silver halides which have been chemically sensitized with gold and the like. The fog problems often associated with emulsions, such as gold-sensitized emulsions which have been hardened by reducing hardeners such as formaldehyde, mucochloric acid and the like are substantially reduced by the use of the polymer-gelatin emulsions which do not require reducing hardeners to achieve a hardened emulsion. However, the emulsion layers and other layers present in photographic elements made according to this invention can be hardened with any suitable hardener such as aldehydes, bis(vinylsulfonyl) compounds, mucochloric acid and the like, aziridine hardeners, hardeners which are derivatives of dioxane, oxypolysaccharides such as oxystarch, oxy plant gums and the like. Useful concentrations of hardeners are related to the amount of polymer and/or gelatin binder used and are known to those skilled in the art. Such hardened layers will have a melting point in water greater than about 150° F. and preferably greater than 200° F.

The silver halide emulsion used herein can also contain additional additives, particularly those known to be beneficial in photographic emulsions, including, for example, stabilizers or antifoggants, particularly the water-soluble inorganic acid salts of cadmium, cobalt, manganese and zinc as disclosed in U.S. Pat. No. 2,829,404, the substituted triazaindolizines as disclosed in U.S. Pat. Nos. 2,444,605 and 2,444,607, speed-increasing materials, absorbing dyes, plasticizers and the like. Sensitizers which give particularly good results in the photographic compositions disclosed herein are the alkylene oxide polymers which can be employed alone or in combination with other materials, such as quaternary ammonium salts, as disclosed in U.S. Pat. No. 2,866,437, or with mercury compounds and nitrogen-containing compounds, as disclosed in U.S. Pat. No. 2,751,299.

In the various color transfer processes capable of being employed in instant photographic processes, an aqueous alkaline processing medium is generally used to develop the image and allow for the imagewise diffusion of the color-providing materials. In order properly to terminate development, inhibit dye diffusion, and to prevent aerial oxidation of developing agents (increase image stability), it is essential to lower the pH after an image is developed. The most common method employed to "shut down" or stop development after a predetermined time, such as 20 to 60 seconds, in some formats, or up to 3 minutes in others, the use of a neutralizing layer such as a polymeric acid is employed.

A timing layer is employed in conjunction with the neutralizing layer so that the pH is not prematurely lowered so as to stop development. The development time is thus established by the time it takes the alkaline composition to penetrate through the timing layer. As the system starts to become stabilized, alkali is depleted throughout the structure by the acid in the neutralizing layer, causing silver halide development to cease in response to this drop in pH. For each image-generating unit, this shutoff mechanism can establish the amount of silver halide development and the related amount of dye formed or transferred according to the respective exposure values.

Various formats for color diffusion transfer assemblages are described in the prior art, such as U.S. Pat. Nos. 2,543,181, 3,415,644, 3,415,645, 3,415,646, 3,647,437, 3,635,707 and 3,756,815 and Canadian Patents 928,559 and 674,082. In these formats, the imagereceiving layer containing the photographic image for viewing can remain permanently attached and integral with the image-generating and ancillary layers present in the structure when a transparent support is employed on the viewing side of the assemblage. The image is formed by dyes and produced in the image-generating units, diffusing through the layers of the structure to the dye image-receiving layer. After exposure of the assemblage, an alkaline processing composition permeates the various layers to initiate development of the exposed photosensitive silver halide emulsion layers. The emulsion layers are developed in proportion to the extent of the respective exposures, and the image dyes in the respective image-generating layers begin to diffuse imagewise throughout the structure. At least a portion of the imagewise distribution of diffusible dyes diffuses to the dye image-receiving layer to form an image of the original subject.

Other so-called "peel-apart" formats for color diffusion transfer assemblages are described, for example, in U.S. Pat. Nos. 2,983,606, 3,362,819 and 3,362,821. In those formats, the image-receiving element is separated from the photosensitive element after development and transfer of the dyes to the image-receiving layer.

The following preparations show methods of preparing the monomers and polymers used in the practice of the present invention:

EXAMPLE A: Preparation of ethyl acryloylacetate and other monomeric vinyl esters The preparation of ethyl acryloylacetate is described by I. N. Nazarov and S. I. Zavyalov, Zh. Obschch. Khim., 23, 1703 (1953); E. Wenkert, A. Afonso, J. B-son Bredenberg, C. Kaneko and A. Tahara, J. Amer. Chem. Soc., 86, 2039 (1964); and G. Stork and R. N. Guthikonda, Tetrahedron Letters, 27, 2755-58 (1972); and follows the following reaction sequence shown below:

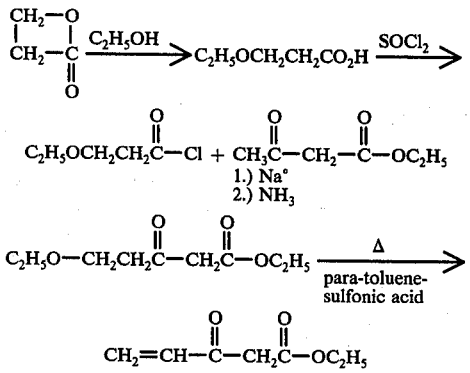

The mixture of compounds tert-butyl endo- and exo-3-(2-norbornen-5-yl)-3-oxopropionate are prepared by adding n-butyllithium (2 moles) in tetrahydrofuran (2 liters) at 0° C. and adding n-isopropylcyclohexylamine (2 moles). To this solution at 78° C. was added dropwise tertiary butyl acetate over a period of 1 hr. followed after 30 min. by the acid chloride having the formula:

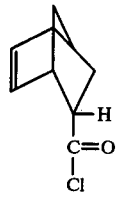

(one mole). The mixture was stirred at room temperature for 1 hour and then quenched with concentrated hydrochloric acid (300 ml.) in water (700 ml.). The mixture was allowed to reach room temperature and the organic layer was separated. The aqueous layer was extracted with ether and the combined extracts were washed with $NaHCO_3$ (500 ml.), dried over anhydrous $MgSO_4$, filtered and the solvent removed. The residue was distilled to isolate the β-keto ester having the formula:

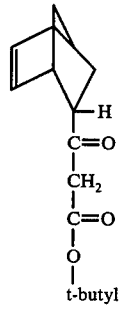

The preparation of tert-butyl acryloylacetate comprised adding the above keto ester over 3 to 4 hours. at the top of a vertical quartz tube packed with quartz chips kept at 500° C. The crude product was collected under reduced pressure in a receiver cooled at −20° C. The material was immediately distilled.

The preparation of N,N-dimethylacryloylacetamide was carried out in the same manner as described above for the β-keto ester. However, the crude material was not distilled before pyrolyzing in the quartz tube.

EXAMPLE B: Preparation of 6-(m- and p-vinylphenyl)-2,4-hexanedione

The preparation of ethyl 5-(m- and p-vinylphenyl)-3-oxopentanoate and 6-(m- and p-vinylphenyl)-2,4-hexanedione followed procedures as described by C. R. Hauser and T. M. Harris, J. Amer. Chem. Soc., 80, 6360 (1958), and L. Weiler, J. Amer. Chem. Soc., 92, 6702 (1970). To a suspension of sodium hydride (41.3 g., 1M) (57% oil dispersion) in tetrahydrofuran (2 l.) at 0–10° C. was added 2,4-pentanedione (100 g., 1M) and the solution was stirred at 0° C. for 15 minutes. Then n-butyllithium (1M) in hexane was added slowly at 0°–10° C. and the solution of the dianion was stirred at 0° C. for an additional 15 minutes. Vinylbenzyl chloride (obtained from Dow Chemical Company as a mixture of meta (60%) and para (40%) isomers (152.5 g., 1M)) was added at 0° C. and the reaction mixture was stirred at room temperature for 1–2 hr. The mixture was poured onto cracked ice containing hydrochloric acid (200 ml.). The organic layer was separated and the aqueous layer was extracted with chloroform (5 × 150 ml.). The combined organic extracts were washed with saturated bicarbonate solution (250 ml.), saturated sodium chloride solution (250 ml.) and water (250 ml.), dried, filtered, and the solvent removed.

The residual oil was diluted with an equal volume of methanol and poured into a large excess of hot copper acetate solution (200 g. in 1750 l. of water). The copper chelate of the diketone fell out, was filtered off and was washed with water, followed by ligroin (1 l.). The copper chelate was then decomposed in the presence of ice-cold 10% sulfuric acid and the mixture extracted with ether (5 × 200 ml.); the ether extracts were washed with saturated bicarbonate solution (2 × 250 ml.), saturated sodium chloride solution (250 ml.) and water (250 ml.), dried, filtered and the solvent removed. The residue was distilled giving 6-(m- and p-vinylphenyl)-2,4-hexanedione boiling at 77°–82° C. at 0.005 mm. The yield was 65%. With analysis, the amount of carbon in the final product was 77.7 weight percent, as compared with 77.8% theoretical; the amount of hydrogen in the final product was 7.6 weight percent, as compared with 7.4% theoretical.

EXAMPLE C: Preparation of poly(acrylamide-co-ethyl acryl oylacetate) (90.0:10.0 weight percent, respectively)

To a mixture of acrylamide (180 g., 2.53 mole) and ethyl acryloylacetate (20 g., 0.14 mole) in water (1600 ml.) and absolute ethanol (125 ml.), maintained under a nitrogen atmosphere, was added 1.0 g. 2,2'-azobis(2-methylpropionitrile). The solution was held at 65° C. for 4 hr. To this mixture was added 1 l. of water and the product was precipitated from solution by the addition of isopropyl alcohol (10 gal.), filtered, washed and dried. The yield of the resulting fluffy, white solid was 170 g.

The polymer composition consistent with the analysis: C, 47.4%, H, 7.6%, N, 17.3%; is 94 weight percent acrylamide and 6 weight percent ethyl acryloylacetate. The inherent viscosity was 0.95 (1 N NaCl).

EXAMPLE D: Preparation of poly(ethyl acryloylacetate-co-N-isopropylacrylamide-co-sodium-3-meth acryloyloxypropane-1-sulfonate) (8.8:6.9:84.3 weight percent, respectively)

To a mixture of N-isopropylacrylamide (20.2 g., 0.18 mole), ethyl acryloylacetate (26.0 g., 0.18 mole) and sodium 3-methacryloyloxypropane-1-sulfonate (248.4 g., 1.08 mole) in water (2250 ml.) and absolute ethanol (180 ml.) under a nitrogen atmosphere was added 2,2'-azobis(2-methylpropionitrile) (1.0 g.) as initiator. The solution was heated at 65° C. overnight. The product was precipitated from the resulting viscous solu tion in water with isopropanol (10 gal.), filtered, washed and dried. The polymer had an inherent viscosity of 0.97 in 1 normal sodium chloride solution.

EXAMPLE E: Preparation of poly(methacrylic acid-co-ethyl acryloylacetate) (50.0:50.0 weight percent, respectively)

To a mixture of methacrylic acid (10 g.) and ethyl acryloylacetate (10 g.) in acetone (40 ml.) was added 2,2'-azobis(2-methylpropionitrile) (0.1 g.) as initiator. The solution was held at 65° C. overnight. The resulting polymer was isolated by precipitation in ether, filtered and dried. The polymer had an inherent viscosity of 0.58 in methanol.

EXAMPLE F: Preparation of poly(ethyl acryloylacetate)

To ethyl acryloylacetate (10.0 g., 0.70M) in benzene (5 ml.) was added 2,2'-azobis(2-methylpropionitrile) (50 mg.). This mixture was held at 65° C. under a nitrogen atmosphere overnight. The resulting viscous mass was dissolved in acetone and precipitated in isopropanol. The resulting polymer was immediately filtered and dissolved in acetone. The yield was 7.0 g.

EXAMPLE G: Preparation of poly[6-(m- and p-vinylphenyl)-2,4-hexanedione]

To 6-(m-and p-vinylphenyl)-2,4-hexanedione (10.0 g., 0.046 M) in benzene (5 ml.) was added 2,2'-azobis(2-methylpropionitrile) (50 mg.). This mixture was held at 60° C. under a nitrogen atmosphere overnight. The resulting viscous mass was dissolved in acetone and precipitated in isopropanol. The resulting polymer was immediately filtered and dissolved in acetone for future use. The yield was 8.0 g.

EXAMPLE H: Preparation of poly[6-(m- and p-vinylphenyl)-2,4-hexanedione]

To 6-(m- and p-vinylphenyl-2,4-hexanedione (13 g., 0.06 M) in 60 ml. of water and 1 ml. of Triton 770® (40% active ingredient) anionic surface active agent was added potassium persulfate (100 mg.) and sodium bisulfite (33 mg.). This emulsion system was then held at 80° C. under a nitrogen atmosphere for 2 hr. The resulting emulsion was dialyzed overnight in a distilled water bath. The yield was 10.0 g.

EXAMPLE I: Preparation of poly[acrylamide-co-6-(m- and p-vinylphenyl)-2,4-hexanedione] (10.0:90.0 weight percent, respectively)

To water (120 ml.), potassium persulfate (200 mg.) and sodium bisulfite (20 mg.) at 80° C. under a nitrogen atmosphere were added, simultaneously, 6-(m- and p-vinylphenyl)-2,4-hexanedione (18 g., 0.083 M) from one dropping funnel and acrylamide (2 g., 0.028 M) and sodium bisulfite (20 mg.) in water (20 ml.) from another funnel. This emulsion system was kept at 80° C. under a nitrogen atmosphere for 2 hr. The resulting emulsion was dialyzed overnight in a distilled water bath. The yield was 20 g.

EXAMPLE J: Preparation of poly[6-(m- and p-vinylphenyl)-2,4-hexanedione-co-sodium 3-methacryloyloxy propane-1-sulfonate] (48.5:51.5 weight percent, respectively)

To a mixture of 6-(m- and p-vinylphenyl)-2,4-hexanedione (130 g., 0.6 M) and sodium 3-methacryloyloxypropane-1-sulfonate (138 g., 0.6 M) in dimethyl sulfoxide (800 ml.), maintained under a nitrogen atmosphere, were added 2.0 g. of 2,2'-azobis(2-methylpropionitrile). The solution was kept at 60°–65° C. for 20 hours. The product was precipitated from solution with isopropanol (4 gal.), filtered, washed, and the resulting white solid dissolved immediately in water at 15.7% solids. The yield was 100%.

EXAMPLE K: Preparation of poly[6-(m- and p-vinylphenyl)-2,4-hexanedione-co-sodium 2-acrylamido-2-methylpropane-1-sulfonate] (48.5:51.5 weight percent, respectively)

To a mixture of 6-(m- and p-vinylphenyl)-2,4-hexanedione (6.5 g., 0.03 M) and sodium 2-acrylamido-2-methylpropanesulfonate (6.9 g., 0.03 M) in dimethyl sulfoxide (40 ml.), maintained under a nitrogen atmosphere, was added 2,2'-azobis(2-methylpropionitrile) (0.1 g.). The solution was kept at 60°-65° C. for 20 hours. The product was precipitated from solution with isopropanol (1 gal.), filtered, washed, and the resulting white solid dissolved immediately in water at 11.1% solids. The yield was 55%.

EXAMPLE L: Preparation of poly[6-(m- and p-vinylphenyl)-2,4-hexanedione-co-sodium p-styrenesulfonate] (51.2:48.8 weight percent, respectively To a mixture of 6-(m- and p-vinylphenyl)-2,4-hexanedione (13.0 g., 0.06 M) and sodium p-styrenesulfonate (12.4 g., 0.06 M) in dimethyl sulfoxide (60 ml.), maintained under a nitrogen atmosphere, was added 2,2'-azobis(2-methylpropionitrile) (0.2 g.). The solution was kept at 60°-65° C. for 20 hr. The product was precipitated from solution with isopropanol (1 gal.), filtered, washed, and the resulting white solid dissolved immediately in water at 13.3% solids. The yield was 80%.

EXAMPLE M: Preparation of poly[acrylamide-co-6-(m- and p-vinylphenyl)-2,4-hexanedione] (90:10 weight percent, respectively)

To a mixture of acrylamide (18.0 g., 0.253 M) and 6-(m- and p-vinylphenyl)-2,4-hexanedione (2 g., 0.009 M) in water (160 ml.) and absolute ethanol (20 ml.), maintained under a nitrogen atmosphere, was added 2,2'-azobis(2-methylpropionitrile) (0.1 g.). The solution was kept at 65° C. for 6 hours. The product was precipitated from the resulting viscous solution with isopropanol (4.1 gal.), filtered, washed, and immediately dissolved in water at 5.5% solids. The polymer had an inherent viscosity of 1.21 in 1 normal sodium chloride solution.

The following polymers were prepared in a manner similar to the preparation of the polymer of Example C:

- poly[acrylamide-co-6-(m- and p-vinylphenyl)-2,4-hexanedione] (90:10 and 85:15 weight percent, respectively)
- poly[acrylamide-co-N,N-diethyl-5-(m- and p-vinylphenyl)-3-oxopentanamide] (90:10 weight percent, respectively)
- poly[acrylamide-co-ethyl 5-(m- and p-vinyl-phenyl)-3-oxopentanoate] (90:10 and 80:20 weight percent, respectively)
- poly[acrylamide-co-N,N-dimethylacryloylacetamide] (80:20 and 90:10 weight percent, respectively)

Other polymers within the scope of this invention which have been prepared in a similar fashion as the polymer in Example F include:

- poly[ethyl 5-(m- and p-vinylphenyl)-3-oxopentano ate]
- poly[N,N-diethyl-5-(m- and p-vinylphenyl)-3-oxo pentanamide],
- poly[t-butyl 5-(m- and p-vinylphenyl)-3-oxopentanoate]

The following polymers were prepared in a similar manner as the polymer in Example I in weight ratios of the first polymerized monomer to the second polymerized monomer from about 1:9 to about 4:1.

- poly[methacrylic acid-co-ethyl acryloylacetate] (15:85 and 10:90, weight percent, respectively)
- poly[methacrylic acid-co-6-(m- and p-vinyl phenyl)-2,4-hexanedione] (15:85 and 10:90, weight percent, respectively) poly[methacrylic acid
- poly[methacrylic acid-co-ethyl 5-(m- and p-vinyl phenyl)-3-oxopentanoate] (15:85 and 10:90, weight percent, respectively)
- poly[methacrylic acid-co-N,N-diethyl-5-(m- and p-vinylphenyl)-3-oxopentanamide] (15:85 weight percent, respectively)
- poly[methacrylic acid-co-t-butyl 5-(m- and p-vinylphenyl-3-oxopentanoate] (15:85 weight percent, respectively)
- poly[n-butyl acrylate-co-methacrylic acid-coethyl acryloylacetate] (10:10:80 weight percent, respectively)
- poly[n-butyl acrylate-co-methacrylic acid-co-6-(m- and p-vinylphenyl)-2,4-hexanedione] (10:15:75 weight percent, respectively)
- poly[n-butyl acrylate-co-ethyl acryloylacetate] (50:50 weight percent, respectively)
- poly[n-butyl acrylate-co-6-(m- and p-vinylphenyl)-2,4-hexanedione] 50:50 weight percent, respectively)

The following polymers which are within the scope of this invention were prepared by solution polymerization in benzene:

- poly[2-hydroxyethyl methacrylate-co-ethyl acryloylacetate] (1.0:4.0 molar ratio)
- poly[2-hydroxyethyl methacrylate-co-6-(m- and p-vinylphenyl)-2,4-hexanedione] 1.0:3.0 molar ratio)

Example N: Preparation of poly[2-acetoacetoxyethyl acrylate-co-acrylic acid-co-n-butyl acrylate]

Water (175 ml.) was swept with nitrogen for 10 min. and placed in a 3-necked flask in a bath at 80° C. Triton® 770 (a 40% solution of a surfactant composition comprising a sodium salt of an alkyl aryl polyether sulfate in isopropanol) (2 ml.), potassium persulfate (0.5 g.) and sodium bisulfite (0.05 g.) were then added to the water. The following two solutions were added to this mixture simultaneously with stirring:

(a) butyl acrylate (51.5 g.), acrylic acid (6.75 g.) and 2-acetoacetoxyethyl acrylate (10.0 g.) and (b) sodium bisulfite (0.1 g.) and Triton® 770 (2 ml.) in water (75 ml.).

The additions of (a) and (b) were completed in 10 minutes under a nitrogen atmosphere with the flask maintained at 80° C. After heating for an additional 15 minutes, the resulting latex was cooled. The copolymer latex had the molar composition of 75.7% butyl acrylate, 14.9% acrylic acid and 9.4% 2-acetoacetoxyethyl acrylate. It was prepared at two pH levels: 5.0 and 6.2.

Example O: Preparation of poly[2-acetoacetoxyethyl methacrylate-co-acrylic acid-co-ethyl acrylate]

A solution of ethyl acrylate (7.5 g.), acrylic acid (2.0 g.) and 2-acetoacetoxyethyl methacrylate (1.0 g.) in dioxane (10 ml.) was mixed with 0.05 g. of 2,2'-azobis(2-methylpropionitrile) and maintained at 80° C. for 1 hour. The resulting terpolymer was isolated by precipitation in water.

Other terpolymers according to this invention can be prepared by the methods shown in Examples N and O.

Practice of the Invention

The following examples illustrate the use of homopolymers or copolymers containing active methylene groups in their side chains as pH selectively permeable layers in diffusion transfer elements and film units. Table 1 identifies the materials used.

Table 1

| Compound Identification | Compound Name |
|---|---|
| | Active Methylene Group-Containing Monomers |
| $A_1$ | ethyl acryloylacetate |
| $A_2$ | 2-acetoacetoxyethyl methacrylate |
| $A_3$ | ethyl 5-(m- and p-vinylphenyl)-3-oxo-pentanoate |
| $A_4$ | t-butyl 5-(m- and p-vinylphenyl)-3-oxo-pentanoate |
| $A_5$ | N,N-diethyl-5-(m- and p-vinylphenyl)-3-oxopentanoic acid amide |
| $A_6$ | acryloylacetone |
| $A_7$ | methacryloylacetone |
| $A_8$ | 6-(m- and p-vinylphenyl)-2,4-hexanedione |
| | Hydrophilic Monomers |
| $B_1$ | acrylamide |
| $B_2$ | N-isopropylacrylamide |
| $B_3$ | methacrylic acid |
| $B_4$ | 2-hydroxyethyl methacrylate |
| $B_5$ | N-(1,1-dimethyl-3-dimethylaminopropyl)-acrylamide |
| $B_6$ | p-methanesulfonamidostyrene |
| $B_7$ | acrylic acid |
| $B_8$ | m- and p-vinylphenylacetic acid |
| $B_9$ | m- and p-vinylbenzoic acid |
| $B_{10}$ | 3-acrylamido-3-methylbutanoic acid |
| | Hydrophobic Monomers |
| $C_1$ | methyl acrylate |
| $C_2$ | methyl methacrylate |
| $C_3$ | ethyl acrylate |
| $C_4$ | ethyl methacrylate |
| $C_5$ | n-butyl methacrylate |
| $C_6$ | styrene |
| $C_7$ | n-butyl acrylate |

DYE-RELEASING COMPOUNDS

I

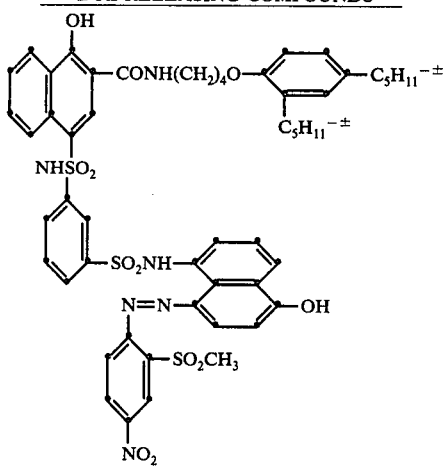

II

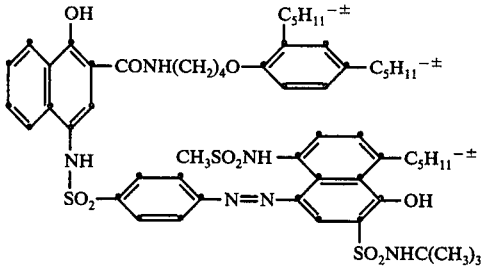

-continued

III

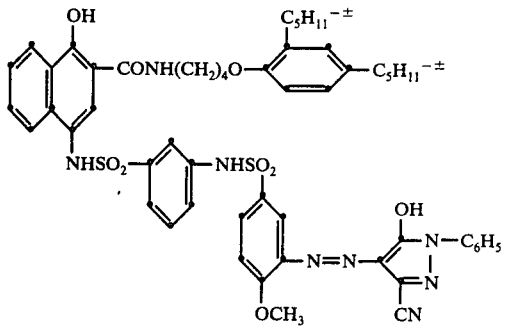

Polymeric materials for use as barrier layers in photographic elements were evaluated as follows:

Test I: Cyan dye access time

Hand coatings of the polymer to be tested were applied at a coverage of 1.6 g./m.$^2$ to an element comprising the following layers coated on a polyester support:

1. image-receiving layer of gelatin (2.2 g.m.$^2$) and poly(styrene-co-N-vinylbenzyl-N-benzyl-N,N-dimethylammonium chloride-co-divinylbenzene) (2.2 g./m.$^2$);

2. reflecting layer of titanium dioxide (21.5 g./m.$^2$) and gelatin (3.2 g./m.$^2$); and 3. opaque layer of carbon (2.2 g.m.$^2$) and gelatin (1.7 g./m.$^2$). The coatings were dipped in a 0.05% solution of Compound IV*, cyan dye at a pH of 13 for 1 min., washed with distilled water, and examined visually through the backing support to assess whether the dye diffused through the "barrier" layer at a pH of 13 within a resonable dye diffusion time (less than 1 minute).

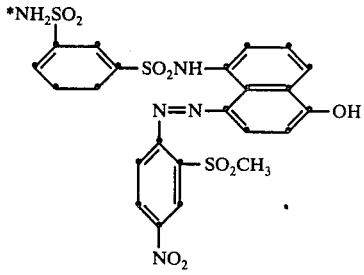

Test II: pH Sensitivity

Samples prepared as described in Test I were placed in one of three 0.05% solutions of methyl orange dye buffered respectively to a pH of 4, 6 and 8 for 3 minutes, washed in distilled water and observed as in Test I to determine whether the "barrier" layer would adequately prevent dye diffusion at low pH. Methyl orange dye was used for this test because the cyan dye employed in Test I is insoluble at these low pH values.

From among many samples of polymers including hydroxyl group-containing polymers and acetals thereof of the type described in the prior art, as well as polymeric acids, phenols, and hydrazides containing no crosslinkable active methylene groups, only those indicated in the following Table 2 exhibited satisfactory dye access times, i.e., allowed a visible amount of dye to diffuse through the layer of pH 13 in 1 minute or less as evidenced by Test I and, further, exhibited pH sensitivity and ability to prevent dye diffusion at pH 4 in accordance with Test II.

Table 2

| Polymer Compositions* | | | | | |
|---|---|---|---|---|---|
| Active Methylene Group-Containing Monomer | | Hydrophilic Monomer | | Hydrophobic Monomer | |
| Monomer | Mole Percent | Monomer | Mole Percent | Monomer | Mole Percent |
| $A_6$ | 100 | | | | |
| $A_1$ | 50 | $B_2$ | 50 | | |
| $A_1$ | 40 | $B_2$ | 60 | | |
| $A_1$ | 85 | $B_3$ | 15 | | |
| $A_1$ | 71 | $B_3$ | 29 | | |
| $A_8$ | 33 | $B_2$ | 67 | | |
| $A_8$ | 25 | $B_2$ | 75 | | |
| $A_8$ | 33 | $B_6$ | 67 | | |
| $A_8$ | 25 | $B_6$ | 75 | | |
| $A_2$ | 65 | $B_1$ | 35 | | |
| $A_2$ | 83 | $B_3$ | 17 | | |
| $A_2$ | 77 | $B_4$ | 23 | | |
| $A_2$ | 33 | $B_2$ | 67 | | |
| $A_3$ | 14 | $B_2$ | 86 | | |
| $A_3$ | 12.5 | $B_2$ | 87.5 | | |
| $A_3$ | 11 | $B_2$ | 89 | | |
| $A_3$ | 67 | $B_3$ | 33 | | |
| $A_2$ | 1.8 | $B_7$ | 31.1 | $C_3$ | 67.1 |
| $A_2$ | 2.2 | $B_7$ | 25.2 | $C_3$ | 72.6 |
| $A_2$ | 100 | | | | |
| $A_2$ | 5 | $B_3$ | 47 | $C_7$ | 48 |
| $A_2$ | 5 | $B_3$ | 44.5 | $C_4$ | 50.5 |
| $A_2$ | 2.5 | $B_3$ | 35.4 | $C_4$ | 62.1 |
| $A_2$ | 2.3 | $B_3$ | 22 | $C_3$ | 75.7 |
| $A_2$ | 2.3 | $B_3$ | 27.3 | $C_2$ | 70.4 |
| $A_6/A_7$ | 70/30 | | | | |
| $A_6/A_7$ | 55/45 | | | | |

*The figures given represent the amount of monomers used to prepare the polymers.

EXAMPLE 1

An integral multicolor photosensitive element was prepared by coating the following layers in the order recited on a transparent poly(ethylene terephthalate) film support. The coverages in g./m.$^2$ are given in parentheses.

(1) image-receiving layer containing a latex of poly(styrene-co-N-benzyl-N,N-dimethyl-N-vinylbenzylammonium chloride-co-divinylbenzene) (2.2) and gelatin (2) reflecting layer of titanium dioxide (24.8) and gelatin 83.7);

(3) pH selectively permeable "barrier" layer of poly(methacrylic acid-co-ethyl acryloylacetate) (mole ratio 1:5.5) (1.I);

(4) opaque layer of carbon black (2.7) in gelatin (1.7);

(5) Compound I (0.54) and gelatin (1.1);

(6) interlayer of gelatin (0.54);

(7) red-sensitive, internal-image direct-positive gelatin-silver bromide emulsion (1.2 Ag; 1.2 gel), 5-sec-octadecylhydroquinone-2-sulfonic acid (16 g./mole silver) and nucleating agent Compound V* (1.5 g./mole silver);

*Compound V
1-acetyl-2-{4-[5-amino-2-(2,4-di-t-pentylphenoxy)benzamido]phenyl} hydrazine -continued

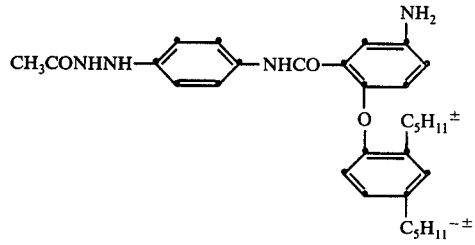

(8) interlayer of di-sec-dodecylhydroquinone (1.1) and gelatin (1.0);

(9) Compound II (0.54) andgleatin (1.1);

(10) green-sensitive, internal-image direct-positive gelatin-silver bromide emulsion (1.2 Ag; 1.2 gel), 5-sec-octadecylhydroquinone-2-sulfonic acid (16 g./mole silver) and nucleating agent Compound IV (2.0 g./mole silver);

(11) interlayer as Layer 8;

(12) Compound III (0.05) and gelatin (1.1);

(13) blue-sensitive, internal-image direct-positive gelatin-silver bromide emulsion (1.1 Ag; 1.1 gel), 5-sec-octadecylhydroquinone-2-sulfonic acid (16 g./mole silver) and nucleating agent Compound V (1.5 g./mole silver); and

(14) gelatin overcoat layer (0.54).

A second multicolor element was exactly the same as the first element except that the selectively permeable pH "barrier" Layer 3 was omitted. This was a control element.

The above-prepared photosensitive elements were then exposed to a graduated-density multicolor test object. The following processing composition was employed in a pod and was spread in a layer of 70μm between the photosensitive element and a cover sheet by passing the transfer "sandwich" between a pair of juxtaposed pressure rollers. The cover sheet was prepared by coating the following two layers in order on a transparent poly(ethylene terephthalate) support (coverages in g.m.$^2$):

(1) polymeric acid layer of polyacrylic acid (15.5);

(2) timing layer of a 95/5 (by weight) mixture of cellulose acetate (40% acetyl) and poly(styrene-co-maleic anhydride), respectively (4.3).

The processing composition was:

| | | |
|---|---|---|
| potassium hydroxide | 56 | g. |
| 4-hydroxymethyl-4-methyl-1-phenyl-3-pyrazolidone | 8 | g. |
| 5-methylbenzotriazole | 2.4 | g. |
| t-butylhydroquinone | 0.2 | g. |
| sodium sulfite (anhydrous) | 2 | g. |
| carbon | 100 | g. |
| carboxymethylcellulose | 51 | g. |
| water to make 1 liter | | |

Both processed laminates were evaluated after 3 days' storage at room temperature (21° C.) and in the "wet oven" at 60° C. and 70% relative humidity. The results are shown in Table 3.

Table 3

| Coating | Dmax | | | Dmin | | |
|---|---|---|---|---|---|---|
| Condition | Red | Green | Blue | Red | Green | Blue |
| Example I | | | | | | |
| room keep | 1.76 | 2.06 | 1.58 | .19 | .23 | .25 |
| wet oven | 1.94 | 1.94 | 1.43 | .22 | .26 | .31 |
| ΔD | +.18 | −.12 | −15 | +.03 | +.03 | +.06 |

Table 3-continued

| Coating Condition | Dmax Red | Dmax Green | Dmax Blue | Dmin Red | Dmin Green | Dmin Blue |
|---|---|---|---|---|---|---|
| control | | | | | | |
| room keep | 1.60 | 1.87 | 1.54 | .19 | .23 | .25 |
| wet oven | 2.06 | 1.80 | 1.31 | .35 | .29 | .32 |
| ΔD | +.46 | −.10 | −.23 | +.16 | +.06 | +.07 |

The data show continued migration of the cyan dye, accelerated in the wet oven, even at the final pH of the system, the effect being much more extensive in the absence of the pH "barrier" layer. The presence of the pH "barrier" layer in Example 1 significantly reduced the buildup of cyan Dmax. The yellow dye density in the control drops during the wet-oven keeping, which may be due to competitive adsorption of the yellow dye in other layers of the element. The selectively permeable pH "barrier" layer appears to reduce significantly the density loss of yellow dye.

EXAMPLE 2

Two integral multicolor photosensitive elements, Example 2 and control, were prepared and tested as in Example 1 except that the selectively permeable pH "barrier" layer in Example 2 was coated as Layer 2 above the image-receiving layer, the reflecting layer being Layer 3. This layer comprised poly(butyl acrylate-co-methacrylic acid-co-2-acetoacetoxyethyl methacrylate) in a molar ratio of monomers of 9:9:1 coated at 1.1 g./m.$^2$. The control element was the control without the selectively permeable pH "barrier" layer.

These coatings were exposed and processed under the same conditions as in Example 1. The results are shown in Table 4.

Table 4

| Coating Condition | Dmax Red | Dmax Green | Dmax Blue | Dmin Red | Dmin Green | Dmin Blue |
|---|---|---|---|---|---|---|
| Example 2 | | | | | | |
| room keep | 1.41 | 1.38 | 0.97 | 0.16 | 0.19 | 0.28 |
| wet oven | 1.62 | 1.43 | 0.94 | 0.22 | 0.22 | 0.32 |
| ΔD | +.21 | +.05 | −.03 | +.06 | +.03 | +.04 |
| control | | | | | | |
| room keep | 1.37 | 1.47 | 1.19 | 0.20 | 0.20 | 0.30 |
| wet oven | 1.74 | 1.58 | 1.12 | 0.36 | 0.28 | 0.40 |
| ΔD | +.37 | +.11 | −.07 | +.16 | +.08 | +.04 |

When the pH "barrier" layer of the terpolymer containing 10% of the polymer having active methylene groups was coated between the image-receiving and the reflecting layers, the cyan dye buildup, both in Dmin and Dmax areas, was significantly reduced.

This invention has been described in detail with particular reference to certain preferred embodiments thereof, but it will be understood that variations and modifications can be effected within the spirit and scope of the invention.

We claim:

1. An image-transfer film unit comprising:

(a) a photosensitive element comprising a support, having thereon at least one silver halide emulsion layer in association with an image dye or an image dye-providing material which is capable of diffusing to an image receiving layer;

(b) an image-receiving layer;

(c) a developing agent;

(d) interposed between all light-sensitive silver halide emulsion layers and said image-receiving layer, at least one pH selectively permeable layer comprising a homopolymer or a copolymer comprising repeating units of a polymerized monomer containing at least one active methylene group and having the formula:

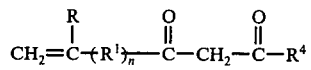

wherein $n$ is 0 or 1; R is hydrogen or methyl; $R^1$ is substituted or unsubstituted arylenethylene having the structure;

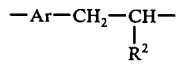

wherein Ar is arylene and $R^2$ is hydrogen, alkyl, aryl or cycloalkyl, or $R^1$ has the formula:

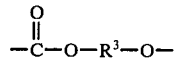

wherein $R^3$ is alkylene, arylene or cycloalkylene; $R^4$ is alkyl, alkoxy or amino when $n$ is equal to 0, and $R^4$ is alkyl, alkoxy, amino, cycloalkyl or aryl when $n$ is equal to 1; and (e) means containing an alkaline processing composition adapted to discharge its contents within said film unit, said polymerized monomer being selectively permeable to image-forming materials at a pH of 10 or more and selectively impermeable to image-forming materials at a pH of 7 or less.

2. The image-transfer film unit of claim 1 wherein the selectively permeable layer comprises a homopolymer or a copolymer comprising repeating units of a polymerized monomer containing at least one active methylene group and having the formula:

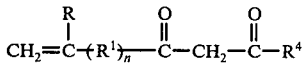

wherein $n$ is 0 or 1; R is hydrogen or methyl; $R^1$ is unsubstituted arylenethylene having the structure:

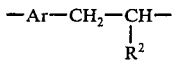

wherein Ar is arylene and $R^2$ is hydrogen, or $R^1$ has the formula:

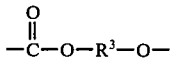

wherein $R^3$ is alkylene; $R^4$ is alkyl or alkoxy when $n$ is equal to 0, and $R^4$ is alkyl, alkoxy or amino when $n$ is equal to 1.

3. The image-transfer film unit of claim 2 wherein the polymerized monomer of the formula:

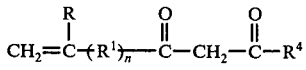

is selected from the group consisting of 2-acetoacetoxyethyl methacrylate, t-butyl 5-(m- and p-vinylphenyl)-3-oxopentanoate, N,N-diethyl-5-(m- and p-vinyl-phenyl)-3-oxopentanoic acid amide, ethyl acryloylacetate, tert-butyl acryloylacetate, ethyl 5-(m- and p-vinylphenyl)-3-oxopentanoate, acryloylacetaone, methacryloylacetone, 6-(m- and p-vinylphenyl)-2,4-hexanedione and N,N-dimethylacryloylacetamide.

4. The image-transfer film unit of claim 1 wherein the pH selectively permeable layer further comprises a hardener.

5. The image-transfer film unit of claim 1 wherein the concentration of the homopolymer or copolymer in the pH selectively permeable layer is in the range of 0.5 to 2.0 grams per square meter of surface.

6. The image-transfer film unit of claim 1 wherein the homopolymer or copolymer has an inherent viscosity in the range of 0.1 to 2.0 in 2-butanone at 25° C.

7. An image-transfer film unit comprising:

(a) a photosensitive element comprising a support, having thereon at least one silver halide emulsion layer in association with an image dye or an image dye-providing material which is capable of diffusing to an image receiving layer;

(b) an image-receiving layer;

(c) a developing agent;

(d) interposed between all silver halide emulsion layers and said image-receiving layer, at least one pH selectively permeable layer comprising a homopolymer or a copolymer comprising:

(i) from about 1 to 100 mole percent of a polymerized monomer containing at least one active methylene group and having the formula:

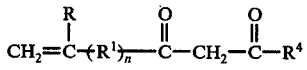

wherein $n$ is 0 or 1; R is hydrogen or methyl; $R^1$ is substituted or unsubstituted arylenethylene having the structure:

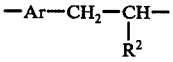

wherein Ar is arylene and $R^2$ is hydrogen, alkyl, aryl or cycloalkyl, or $R^1$ has the formula:

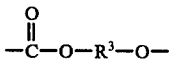

wherein $R^3$ is alkylene, arylene or cycloalkylene; $R^4$ is alkyl, alkoxy or amino when $n$ is equal to 0, and $R^4$ is alkyl, alkoxy, amino, cycloalkyl or aryl when $n$ is equal to 1;

(ii) from 0 to about 90 mole percent of at least one additional hydrophilic polymerized ethylenically unsaturated monomer; and (iii) from 0 to about 80 mole percent of at least one additional hydrophobic polymerized ethylenically unsaturated monomer; and (e) means containing an alkaline processing composition adapted to discharge its contents within said film unit wherein said layer is selectively permeable to image-forming materials at a pH of 10 or more and selectively impermeable to image-forming materials at a pH of 7 or less.

8. The image-transfer film unit of claim 7 wherein the selectively permeable layer comprises a homopolymer or a copolymer comprising:

(a) from about 1 to 100 mole percent of a polymerized monomer containing at least one active methylene group and having the formula:

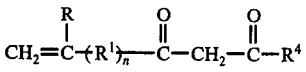

wherein $n$ is 0 or 1; R is hydrogen or methyl; $R^1$ is unsubstituted arylenethylene having the structure:

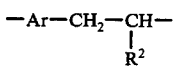

wherein Ar is arylene and $R^2$ is hydrogen, or $R^1$ has the formula:

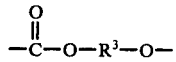

wherein $R^3$ is alkylene; $R^4$ is alkyl or alkoxy when $n$ is equal to 0, and $R^4$ is alkyl, alkoxy or amino when $n$ is equal to 1;

(b) from 0 to about 90 mole percent of at least one additional hydrophilic polymerized ethylenically unsaturated monomer; and (c) from 0 to about 80 mole percent of at least one additional hydrophobic polymerized ethylenically unsaturated monomer.

9. The image-transfer film unit of claim 8 wherein the polymerized monomer of the formula:

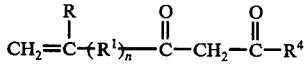

is selected from the group consisting of 2-acetoacetoxyethyl methacrylate, t-butyl 5-(m- and p-vinylphenyl)-3-oxopentanoate, N,N-diethyl-5-(m- and p-vinylphenyl)-3-oxopentanoic acid amide, ethyl acryloylacetate, tert-butylacryloylacetate, ethyl 5-(m- and p-vinylphenyl)-3-oxopentanoate, acryloylacetone, methacryloylacetone, 6-(m- and p-vinylphenyl)-2,4-hexanedione and N,N-dimethylacryloylacetamide.

10. The image-transfer film unit of claim 8 wherein at least one of the additional hydrophilic polymerized ethlenically unsaturated monomers is selected from the group consisting of acrylamide, 3-acrylamido-3-methylbutanoic acid, acrylic acid, N-(1,1-dimethyl-3-dimethylaminopropyl)-acrylamide, 2-hydroxyethyl methacrylate, N-isopropylacrylamide, methacrylic acid, p-methanesulfonamidostyrene, m- and p-vinylphenylacetic acid and m- and p-vinylbenzoic acid.

11. The film unit of claim 8 wherein at least one of the additional hydrophobic polymerized ethylenically unsaturated monomers is selected from the group consisting of n-butyl acrylate, n-butyl methacrylate, ethyl acrylate, ethyl methacrylate, methyl acrylate, methyl methacrylate and styrene.

12. The image-transfer film unit of claim 7 wherein the homopolymer or copolymer has an inherent viscosity in the range of 0.1 to 2.0 in 2-butanone at 25° C.

13. The image-transfer film unit of claim 7 wherein the pH selectively permeable layer further comprises a hardener.

14. The image-transfer film unit of claim 7 wherein the concentration of the homopolymer or copolymer in the pH selectively permeable layer is in the range of 0.5 to 2.0 grams per square meter of surface.

15. An image-transfer film unit comprising:

(a) a photosensitive element comprising a support having thereon at least one silver halide emulsion layer in association with an image dye or an image dye-providing material which is capable of diffusing to an image receiving layer;

(b) an image receiving layer, (c) a developing agent, (d) interposed between all light-sensitive silver halide emulsion layers and said image-receiving layer, at least one pH selectively permeable layer comprising poly(methacrylic acid-co-ethyl acryloylacetate), and (e) means containing an alkaline processing composition adapted to discharge its contents within said film unit.

16. An image-transfer film unit comprising:

(a) a photosensitive element comprising a support having thereon at least one silver halide emulsion layer in association with an image dye or an image dye-providing material which is capable of diffusing to an image receiving layer;

(b) an image-receiving layer, (c) a developing agent, and (d) interposed between all light-sensitive silver halide emulsion layers and said image-receiving layer, at least one pH selectively permeable layer comprising poly(butyl acrylate-co-methacrylic acid-co-2-acetoacetoxyethyl methacrylate) (weight ratio 56:34:10).

17. The image-transfer film unit of claim 16 wherein the support is transparent and in succession the layer on said support are, the image-receiving layer, a reflecting layer, said pH selectively permeable layer, an opaque layer, at least one silver halide emulsion layer in association with an image dye or an image dye-providing material which is capable of diffusing to the image receiving layer, a pod containing the processing composition which is attached to said film unit at one of its edges and which is adapted to discharge its contents within said film unit after exposure, a timing layer, and acid layer and a transparent support.

18. A photosensitive diffusion transfer element comprising a support, having thereon:

(a) at least one silver halide emulsion layer in association with an image dye or an image dye-providing material which is capable of diffusing to an image receiving layer;

(b) an image-receiving layer;

(c) a developing agent; and (d) interposed between all silver halide emulsion layers and said image-receiving layer, at least one pH selectively permeable layer comprising a homopolymer or a copolymer comprising repeating units of a polymerized monomer containing at least one active methylene group and having the formula:

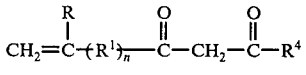

wherein $n$ is 0 or 1; R is hydrogen or methyl; $R^1$ is substituted or unsubstituted arylenethylene having the structure:

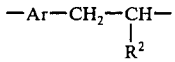

wherein Ar is arylene and $R^2$ is hydrogen, alkyl, aryl or cycloalkyl, or $R^1$ has the formula:

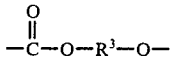

wherein $R^3$ is alkylene, arylene or cycloalkylene; $R^4$ is alkyl, alkoxy or amino when $n$ is equal to 0, and $R^4$ is alkyl, alkoxy, amino, cycloalkyl or aryl when $n$ is equal to 1; and wherein said pH selectively permeable layer is selectively permeable to image-forming materials at a pH of 10 or more and selectively impermeable to image-forming materials at a pH of 7 or less.

19. The photosensitive element of claim 18 wherein the pH selectively permeable layer comprises a homopolymer or a copolymer comprising repeating units of a polymerized monomer containing at least one active methylene group and having the formula:

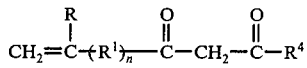

wherein $n$ is 0 or 1; R is hydrogen or methyl; $R^1$ is unsubstituted arylenethylene having the structure:

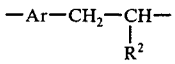

wherein Ar is arylene and $R^2$ is hydrogen, or $R^1$ has the formula:

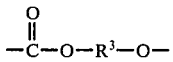

wherein $R^3$ is alkylene; $R^4$ is alkyl or alkoxy when $n$ is equal to 0, and $R^4$ is alkyl, alkoxy or amino when $n$ is equal to 1.

20. The element of claim 18 wherein the polymerized monomer of the formula:

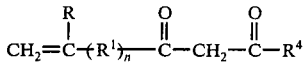

is selected from the group consisting of 2-acetoacetoxyethyl methacrylate, t-butyl 5-(m- and p-vinylphenyl)-3-oxopentanoate, N,N-diethyl-5-(m- and p-vinylphenyl)-3-oxopentanoic acid amide, ethyl acryloylacetate, tert-butylacryloylacetate, ethyl 5-(m- and p-vinylphenyl)-3-oxopentanoate, acryloylacetone, methacryloylacetone, 6-(m- and p-vinylphenyl)-2,4-hexanedione and N,N-dimethylacryloylacetamide.

21. The element of claim 18 wherein the pH selectively permeable layer further comprises a hardener.

22. The element of claim 18 wherein the concentration of the homopolymer or copolymer in the pH selectively permeable layer is in the range of 0.5 to 2.0 grams per square meter of surface.

23. The element of claim 18 wherein the homopolymer or copolymer has an inherent viscosity in the range of 0.1 to 2.0 in 2-butanone at 25° C.

24. A photosensitive, diffusion transfer element comprising a support, having thereon:

(a) at least one silver halide emulsion layer in association with an image dye or an image dye-providing material which is capable of diffusing to an image receiving layer;

(b) an image-receiving layer;

(c) a developing agent; and (d) interposed between all silver halide emulsion layers and said image-receiving layer, at least one pH selectively permeable layer comprising a homopolymer or a copolymer comprising:

(i) from about 1 to 100 mole percent of a polymerized monomer containing at least one active methylene group and having the formula:

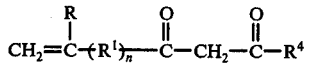

wherein Ar is arylene; $R^2$ is hydrogen, alkyl, aryl or cycloalkyl; $R^1$ has the formula:

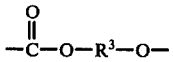

wherein $R^3$ is alkylene, arylene or cycloalkylene; $R^4$ is alkyl, alkoxy or amino when $n$ is equal to 0, and $R^4$ is alkyl, alkoxy, amino, cycloalkyl or aryl when $n$ is equal to 1;

(ii) from 0 to about 90 mole percent of at least one additional hydrophilic polymerized ethylenically unsaturated monomer; and (iii) from 0 to about 80 mole percent of at least one additional hydrophobic polymerized ethylenically unsaturated monomer;

wherein said selectively permeable layer is selectively permeable to image-forming materials at a pH of 10 or more and selectively impermeable to image-forming materials at a pH of 7 or less.

25. The photosensitive element of claim 24 wherein the pH selectively permeable layer comprises a homopolymer or a copolymer comprising:

(a) from about 1 to 100 mole percent of a polymerized monomer containing at least one active methylene group and having the formula:

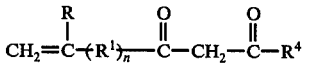

wherein $n$ is 0 or 1; R is hydrogen or methyl; $R^1$ is an unsubstituted arylenethylene having the structure:

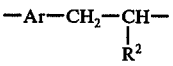

wherein Ar is arylene and $R^2$ is hydrogen, or $R^1$ has the formula:

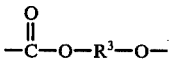

wherein $R^3$ is alkylene; $R^4$ is alkyl or alkoxy when $n$ is equal to 0, and $R^4$ is alkyl, alkoxy or amino when $n$ is equal to 1;

(b) from 0 to about 90 mole percent of at least one additional hydrophilic polymerized ethylenically unsaturated monomer; and (c) from 0 to about 80 mole percent of at least one additional hydrophobic polymerized ethylenically unsaturated monomer.

26. The element of claim 25 wherein the polymerized monomer of the formula:

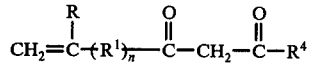

is selected from the group consisting of 2-acetoacetoxyethyl methacrylate, t-butyl 5-(m- and p-vinylphenyl)-3-oxopentanoate, N,N-diethyl-5-(m- and p-vinylphenyl)-3-oxopentanoic acid amide, ethyl acryloylacetate, tert-butylacryloylacetate, ethyl 5-(m- and p-vinylphenyl)-3-oxopentanoate, acryloylacetone, methacryloylacetone, 6-m- and p-vinylphenyl)-2,4-hexanedione and N,N-dimethylacryloylacetamide.

27. The element of claim 25 wherein at least one of the additional hydrophilic polymerized ethylenically unsaturated monomers is selected from the group consisting of acrylamide, 3-acrylamido-3-methylbutanoic acid, acrylic acid, N-(1,1-dimethyl-3-dimethylaminopropyl)acrylamide, 2-hydroxyethyl methacrylate, N-isopropyl acrylamide, methacrylic acid, p-methanesulfonamidostyrene, m- and p-vinylphenylacetic acid and m- and p-vinylbenzoic acid.

28. The element of claim 25 wherein at least one of the additional hydrophobic polymerized ethylenically unsaturated monomers is selected from the group consisting of n-butyl acrylate, n-butyl methacrylate, ethyl acrylate, ethyl methacrylate, methyl acrylate, methyl methacrylate and styrene.

29. The element of claim 24 wherein the homopolymer or copolymer has an inherent viscosity in the range of 0.1 to 2.0 in 2-butanone at 25° C.

30. The element of claim 24 wherein the pH selectively permeable layer further comprises a hardener.

31. The element of claim 24 wherein the concentration of the homopolymer or copolymer in the pH selectively permeable layer is in the range of 0.5 to 2.0 grams per square meter of surface.

32. In a process for forming transfer images which comprises, in combination, the steps of:

(a) exposing a photographic film unit which comprises a support having thereon at least one silver halide emulsion layer in association with an image dye or an image dye-providing material which is capable of diffusing to an image receiving layer, a developing agent, and a means containing an alkaline processing composition adapted to discharge its contents within said film unit;

(b) processing said film unit with said alkaline processing composition;

(c) diffusion of image-forming materials or products thereof to said image-receiving layer; and (d) preventing diffusion of image-forming materials or products thereof to said image-receiving layer subsequent to substantial transfer image formation; the improvement which comprises the presence of, in the photographic film unit, between all silver halide emulsion layers and said image-receiving layer, at least one pH selectively permeable layer comprising a homopolymer or a copolymer comprising:

(I) from about 1 to 100 mole percent of a polymerized monomer containing at least one active methylene group and having the formula:

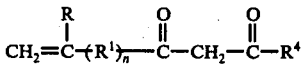

wherein $n$ is 0 or 1; R is hydrogen or methyl; $R^1$ is substituted or unsubstituted arylenethylene having the structure:

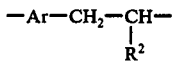

wherein Ar is arylene and $R^2$ is hydrogen, alkyl, aryl or cycloalkyl, or $R^1$ has the formula:

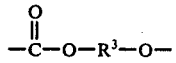

wherein $R^3$ is alkylene, arylene or cycloalkylene; $R^4$ is alkyl, alkoxy or amino when $n$ is equal to 0, and $R^4$ is alkyl, alkoxy, amino, cycloalkyl or aryl when $n$ is equal to 1;

(II) from 0 to about 90 mole percent of at least one additional hydrophilic polymerized ethylenically unsaturated monomer; and (III) from 0 to about 80 mole percent of at least one additional hydrophobic polymerized ethylenically unsaturated monomer;

whereby said pH selectively permeable layer allows diffusion of image-forming materials and products thereof at a pH in excess of 11 and prevents such diffusion at a pH less than 7.

* * * * *